US006527245B2

(12) United States Patent
Graves et al.

(10) Patent No.: US 6,527,245 B2
(45) Date of Patent: Mar. 4, 2003

(54) TRAFFIC CONTROL FLARE HOLDER

(75) Inventors: Gary J. Graves, Webster, NY (US); Steven K. Dahlberg, Pittsford, NY (US)

(73) Assignee: GPS Innovations, LLC, East Rochester, NY (US)

( * ) Notice: Subject to any disclaimer, the term of this patent is extended or adjusted under 35 U.S.C. 154(b) by 0 days.

(21) Appl. No.: 09/867,113

(22) Filed: May 29, 2001

(65) Prior Publication Data

US 2002/0179804 A1 Dec. 5, 2002

(51) Int. Cl.[7] ..... F16M 13/00

(52) U.S. Cl. ..... 248/518; 248/528; 248/150; 102/343

(58) Field of Search ..... 248/518, 528, 248/541, 125.9, 130, 149, 150, 176.1, 176.2, 126, 520; 102/343, 344

(56) References Cited

U.S. PATENT DOCUMENTS 2,049,407 A * 7/1936 Clark ..... 248/46
2,070,882 A * 2/1937 Brown ..... 248/46
2,220,407 A * 11/1940 Joss ..... 246/488
2,306,442 A * 12/1942 Holmes ..... 102/36
2,795,387 A * 6/1957 Elsey ..... 248/46
3,146,613 A * 9/1964 Hiner ..... 67/3
3,520,273 A * 7/1970 Daifotes ..... 116/28
3,905,324 A * 9/1975 English ..... 116/63
4,063,704 A * 12/1977 Rother ..... 248/515
4,159,816 A * 7/1979 Miyamae ..... 248/515
4,917,015 A * 4/1990 Lowery ..... 102/342
5,468,092 A * 11/1995 Saunders ..... 403/385

* cited by examiner

*Primary Examiner*—Leslie A. Braun
*Assistant Examiner*—A. Joseph Wujciak, III
(74) *Attorney, Agent, or Firm*—Stephen B. Salai, Esq.; Roger Aceto, Esq.; Harter, Secrest & Emery LLP

(57) ABSTRACT

A flare holder that is attachable to a traffic cone or other upright support structure for holding a lit flare at an elevation higher than a roadway surface. The flare holder includes a lower portion that is attachable to the upright support structure and an ash receptacle that is pivoted at one end to the lower portion. The ash receptacle is can be pivoted up and over the top of the support structure from a stowed position wherein it is suspended from the pivot to an operative position located between 180° and 270° from the stowed position. In an operative position, the flare holder supports a flare at an upward inclination wherein the ash receptacle has an end portion extending outwardly from the pivot and disposed to receive ashes falling from the lit end of the flare.

15 Claims, 5 Drawing Sheets

256
248
234
232
230
257
230
215
212
214
ROAD
SIDE
CONE

TRAFFIC CONTROL FLARE HOLDER

TECHNICAL FIELD OF THE INVENTION

The present invention relates to a holder for a road flare and more particularly to a flare holder that is attachable to a traffic cone to elevate the flare to a more visible position.

BACKGROUND OF THE INVENTION

Flares are commonly used as temporary signals to mark the location of road hazards such as construction, accidents, other emergency operations and the like or just to provide a temporary warning or to call notice to some given situation. Flares usually are positioned at some distance ahead of the actual site of interest in order to give advanced warning that the site is being approached. Flares of course can be laid on the ground beside a roadway or hand held but neither is desirable for various reasons. Wind or terrain may cause the movement of a flare laid on the ground and holding the flare is not an effective use of personnel that may be at the site addressing a given situation such as an accident. Also, the burning flare produces considerable heat which may damage the roadway and limits the time it can be hand held as the lit end bums toward the butt end.

Various devices are available to hold a flare. These include flares with sharpened spikes at the butt end that can be driven or pushed into the ground or asphalt to hold the lit end upright. The spike often is overlooked after the flare is spent and itself creates a hazard in or adjacent to the roadway.

U.S. Pat. Nos. 2,981,510; 3,149,566; 3,146,613 and 3,285,550 disclose flare holders that lay on the roadway for holding the flare in a generally upright position. U.S. Pat. No. 3,905,324 discloses a flare holder that can lay on the roadway and includes a truncated surface for receiving the spike end of a plurality of flares to hold the flares generally upright. U.S. Pat. No. 4,148,258 discloses a flare holder that is of a flammable material so it selfdestructs when the flare burns down so the holder, after use, does not create a road hazard.

While these holders are more or less effective, they all serve to hold the flare generally upright near the road surface. There are situations that would benefit by having the flare held at a higher level above the road surface. For example the typical 18 inch flare burning near the road surface may not be visible beyond even a small rise in the road. Also, as the flare burns down, it becomes effectively shorter and shorter thus further decreasing the distance from which the flare is visible.

Roadside traffic cones provide an alternate system for providing warning markers. Traffic cones having reflective surfaces are known but these are of reduced value in that reflected light does not necessarily draw the same attention as a flare. Devices are used in conjunction with traffic cones and use the cone as a support so as to take advantage of the additional height provided by the cone. For example, U.S. Pat. No. 4,925,334 discloses a traffic cone having brackets to mount warning flags and signs. U.S. Pat. No. 5,269,251 discloses a traffic control system including an adapter for a traffic cone that allows the cone to support a chemical light stick in a upright, vertical position and U.S. Pat. No. 5,294,924 discloses attaching a flashing battery operated light to the top of a traffic cone. While these devices are useful, flags, chemical lights and battery-operated lights do not generate the same attention as a flare.

Accordingly, there is a need for a low cost device for holding a flare above a roadway surface that protects the road surface from the heat generated by the burning of the flare and combustion residue. A device for holding the flare adds to the safety of traffic control personnel and frees the personnel for more important duty attendant to a road hazard. In a preferred embodiment wherein the flare holder is attachable to a traffic cone, there also is a need to protect the cone from the heat and combustion residue of the burning flare.

SUMMARY OF THE INVENTION

The accordance with the present invention the flare holder includes a support portion releasably attachable to the top of the traffic cone or to any other generally upright structure. The support preferably is generally conical so it can slip over the top of the traffic cone to attach the support to the cone. As an alternative, attachment to the top of the traffic cone is provided by a support portion of the flare holder that extends downward through the open top of the cone. In yet another alternative, the support portion may include fastener openings such as key slots to permit the attachment of the flare holder to a post or other upright structure by screws or nails. Hinged to the support is a plate that can swing between stowed and operating positions. In the stowed position the plate hangs from the hinge and rests generally along the sloping side of the traffic cone.

In its operating position the plate is swung from the stowed position up and over the top of the traffic cone coming to rest at an angle extending outwardly from the vertical axis of the cone some 180° and 270° from its stowed position. Near its hinged end, the plate includes a holder for receiving the butt end of a conventional cylindrical flare so as to orient the longitudinal axis of the flare at an upwardly directed acute angle with respect to the plate.

When the flare is lit and is burning, the lit end is disposed above the plate so that the portion of the plate below the lit end functions as an ash receptacle. Catching the combustion residue from the burning flare prevents damage to the traffic cone, which usually are made of plastic.

Accordingly, the present invention in one aspect thereof may be characterized by a flare holder comprising:

(a) a support having a lower portion attachable to an upright structure and an upper portion, the support defining a generally vertical axis;

(b) a plate having a first end hinged to said support upper portion for movement of said plate about the hinged end between a stowed position depending from the hinged end and an operative position located between 180° and 270° from the stowed position; and (c) means on the plate adjacent the hinged end for supporting the butt end portion of a cylindrical flare when the plate is in its operative position, the means being disposed to support the flare butt end such that the longitudinal axis of the flare is upwardly inclined with the combustible end of the flare being disposed above the plane of the plate.

DETAILED DESCRIPTION OF THE INVENTION

Figure 1:
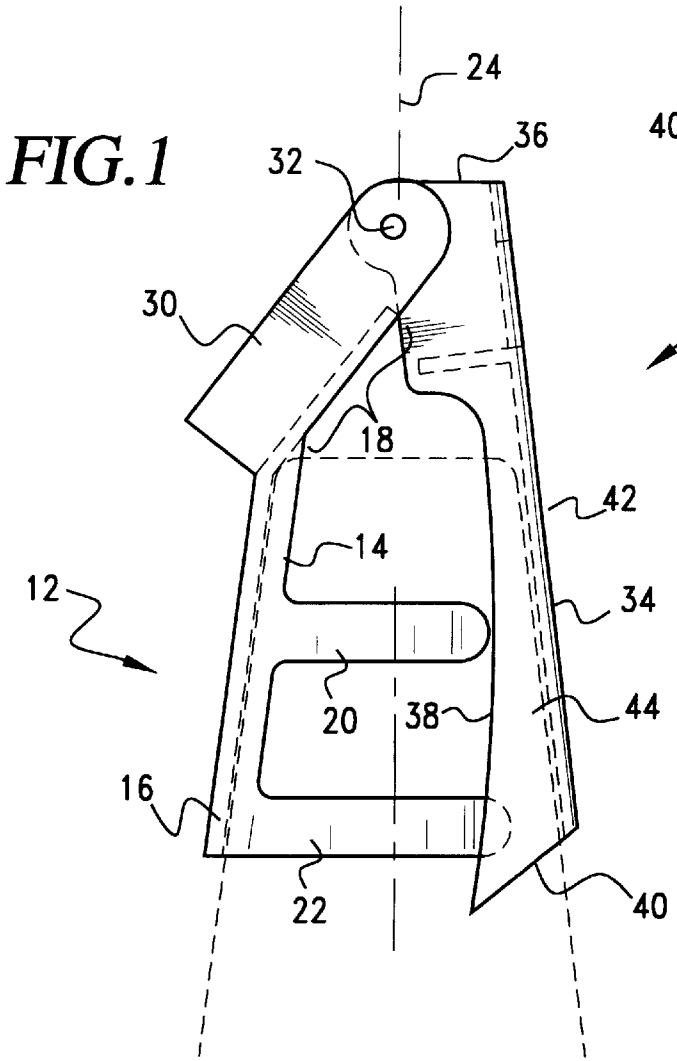
FIG. 1 is a side elevation view of the flare holder of the present invention atop a traffic cone showing the flare holder in a stowed position.

Referring to the drawings, FIG. 1 shows the flare holder of the present invention generally indicated at 10 in a stowed or closed position. The holder includes a support member 12 that is shaped for removable attachment to the top of a traffic cone. In the drawings the outline of the traffic cone is shown in dotted line. In the FIG. 1 embodiment, the support includes a generally upright spine 14 having a lower end 16 and an upper end portion 18. Extending outward from the spine are upper and lower rib pairs 20, 22 respectively. The lower pair of ribs 22 is longer than the upper pair 20 wherein the difference in length allows the spine and ribs to assume a generally conical shape. The spine and ribs together define a sleeve for receiving the upper portion of a traffic cone. In this respect, the ribs 20, 22 are arranged to embrace a portion of a conical traffic cone as shown in dotted line. Preferably the ribs are of a material that has memory so that the ribs grip about the traffic cone when forced down over the cone.

The upper end portion 18 of the spine is bent inward a few degrees from the line of the spine towards the vertical axis 24 of the traffic cone. Attached to the spine upper end portion and forming an extension of the spine are two spaced parallel legs 30. The spine 14 and the parallel legs 30 preferably are formed as one piece wherein the legs comprise opposite side portions of the spine material that are bent over so they extend generally perpendicular to the plane of the spine. Extending between the parallel legs is a hinge pin 32.

Figure 2:
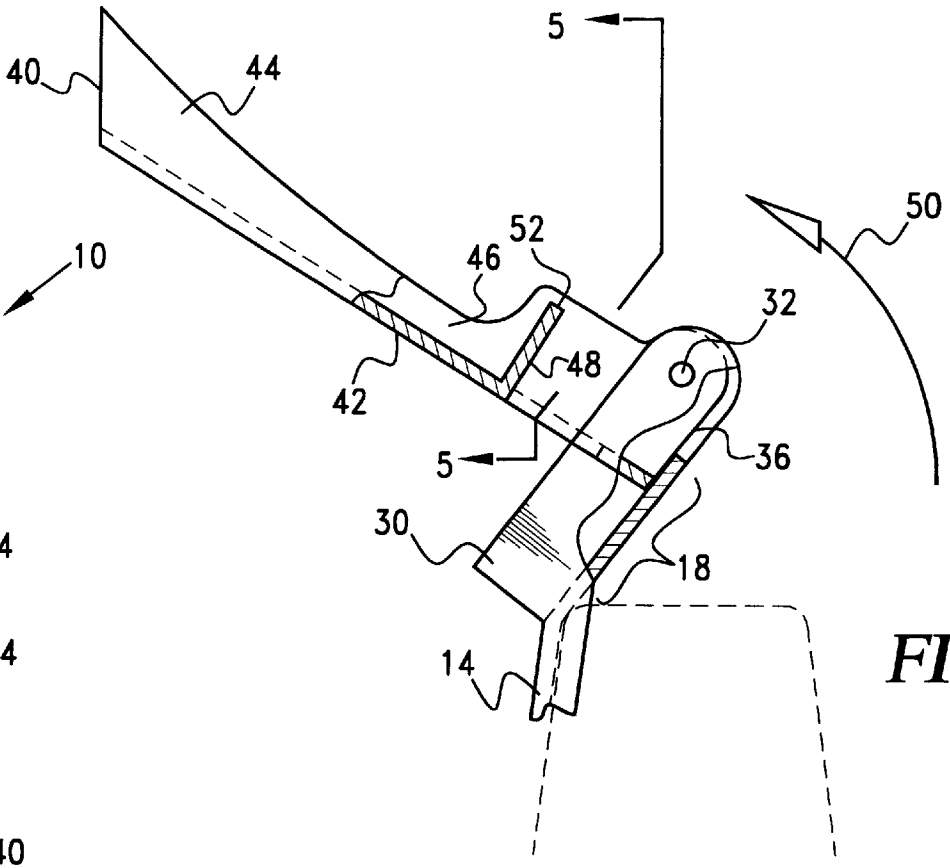
FIG. 2 is a side elevation view partly broken away and in section showing the flare holder in an operative position.
Figure 3:
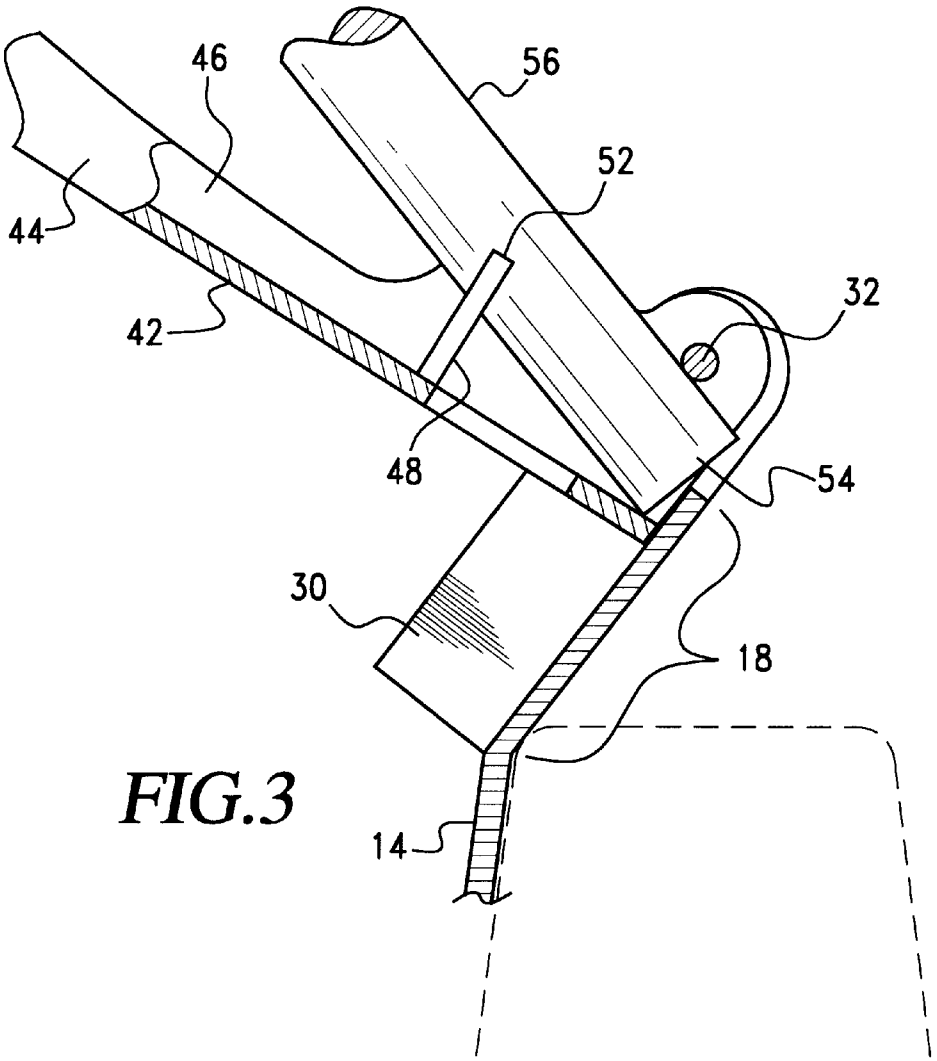
FIG. 3 is a view on an enlarged scale of a portion of FIG. 2 showing a butt end of a flare supported in the flare holder.
Figure 4:
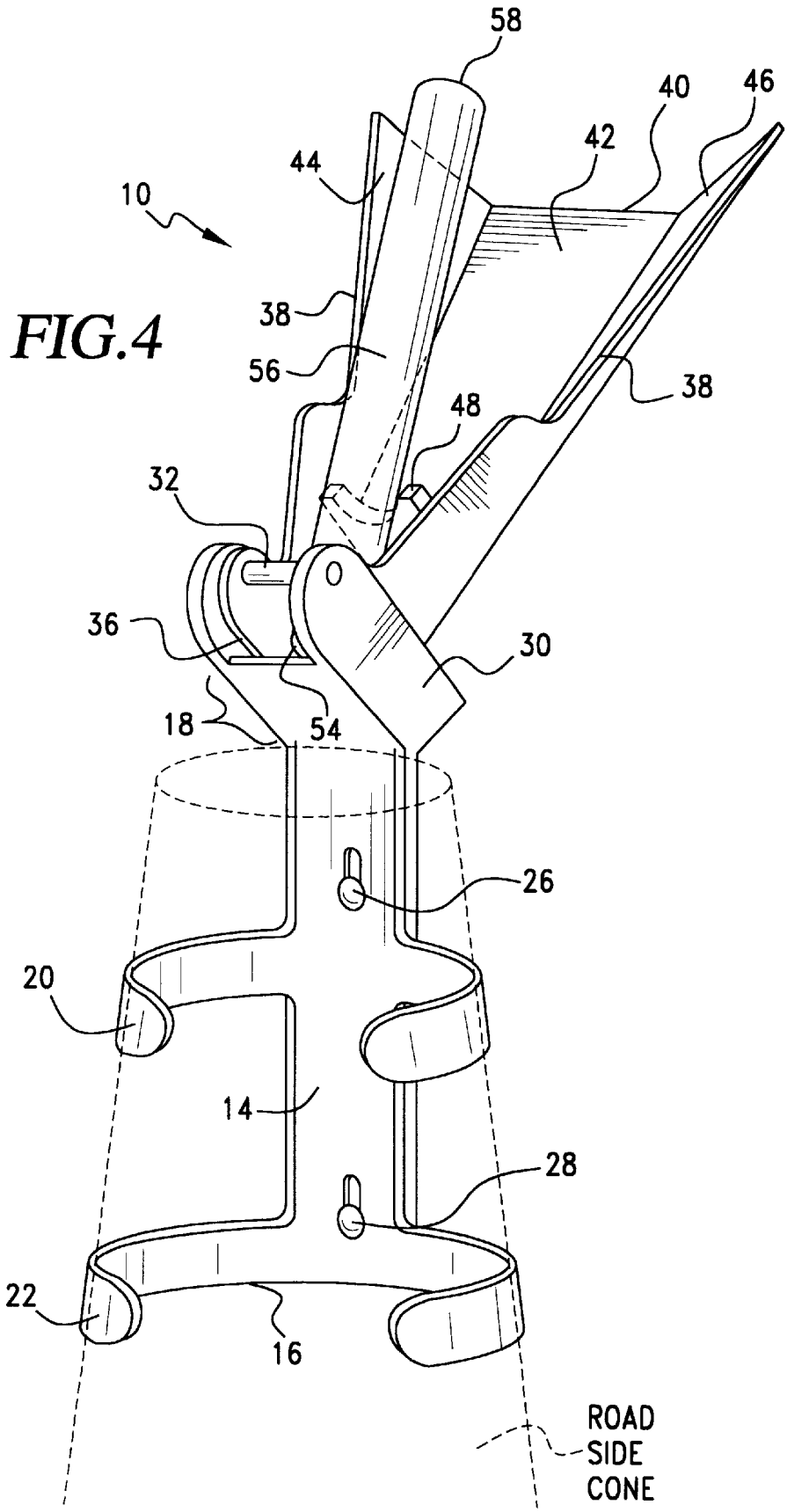
FIG. 4 is a perspective view showing the flare holder in an operative position.

The flare holder 10 further includes a drip shield 34, which is seen in FIG. 1 in a stowed position. The drip shield is a plate that is pivotally connected at one end 36 to the legs 30 by the hinge pin. Thus, the drip shield is movable about the hinge pin 32 from the stowed position as shown in FIG. 1 (wherein the drip shield depends from the hinge pin 32) to an operative position as shown in FIGS. 2–4. Movement from the stowed position to the operative position is accomplished simply by swinging the drip shield up and over the top of the spine. In swinging between these positions, the drip shield travels through an arc of between 180° and 270°.

Figure 5:
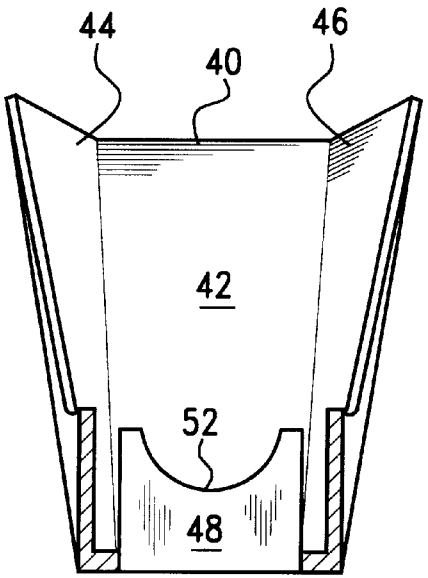
FIG. 5 is a view taken along lines 5—5 of FIG. 2.

The drip shield is configured so as to lie along the side of a traffic cone when it is in the stowed position. In this respect the lateral side edges 38 of the drip shield taper outwardly along its length so that the end 36 connected to the hinge pin is narrower than the opposite end 40. Also, the shield is bent in a transverse direction to generally form a trough as best seen in FIGS. 4 and 5 having a flat base 42 and side walls 44, 46 that angle outwardly from the flat base.

Projecting upwardly from the base 42 is a tang 48 (FIG. 2). The tang can be formed of a separate piece that is attached to the base by welding or other suitable means. However, it is preferred that the projection be formed by cutting through the base on three sides to free a piece of the base. This freed piece then is bent inwardly and away from the base as shown in FIGS. 2–4 to form the tang. Preferably the end edge 52 of the tang is convex or V-shaped as shown in FIG. 5 for purposes set out hereinbelow.

To utilize the embodiment of the flare holder shown in FIGS. 1–5, the holder 10 first is mounted to a traffic cone by slipping the ribs 18, 22 over the cone. Since the ribs have memory, they will grip the outer surface of the cone to fix the flare holder in position. The drip shield 34 initially will be in a stowed position as shown in FIG. 1 wherein the trough shape of the drip shield allows it to nest against the outer surface of the cone. At such time as the holder is put to use, the drip shield 34 first is pivoted up and over the top of the traffic cone as illustrated by arrow 50 (FIG. 2) to swing the shield to its operative position. As the drip shield pivots into position, a portion of the drip shield end 36 will butt against the upper portion 18 of the spine which stops the further motion so the drip shield is held in position by gravity.

As shown in FIGS. 3 and 4, a butt end 54 of a flare 56 is inserted under the hinge pin 32 and against the upper portion 18 of the spine. The body of the flare 56 then is lowered onto the tang 48 so it is cradled by the contour of the upper edge 52 of the tang. With this arrangement, the hinge pin and the tang cooperate to support the flare 56 such that the longitudinal axis of the flare is angled in an upward direction at an acute angle from the drip shield. This serves to elevate the burning end 58 of the flare still farther above the top of the traffic cone to which the flare holder is mounted.

Supporting the flare at an acute angle with respect to the drip shield insures that the as the flare bums down towards the butt end 54, the hot ashes will fall onto the drip shield. In this respect, when the drip shield is in an operative position, its end 40 becomes an outwardly extending end (FIG. 2) disposed beneath a flare for receiving ash falling from the combustible end of the flare. Collecting the ashes in this fashion prevents them from contacting the traffic cone. Since traffic cones usually are made of a plastic material, this prevents damage and possible combustion of the traffic cone. The drip shield also keeps the hot ash from falling onto the road surface.

Figure 6:
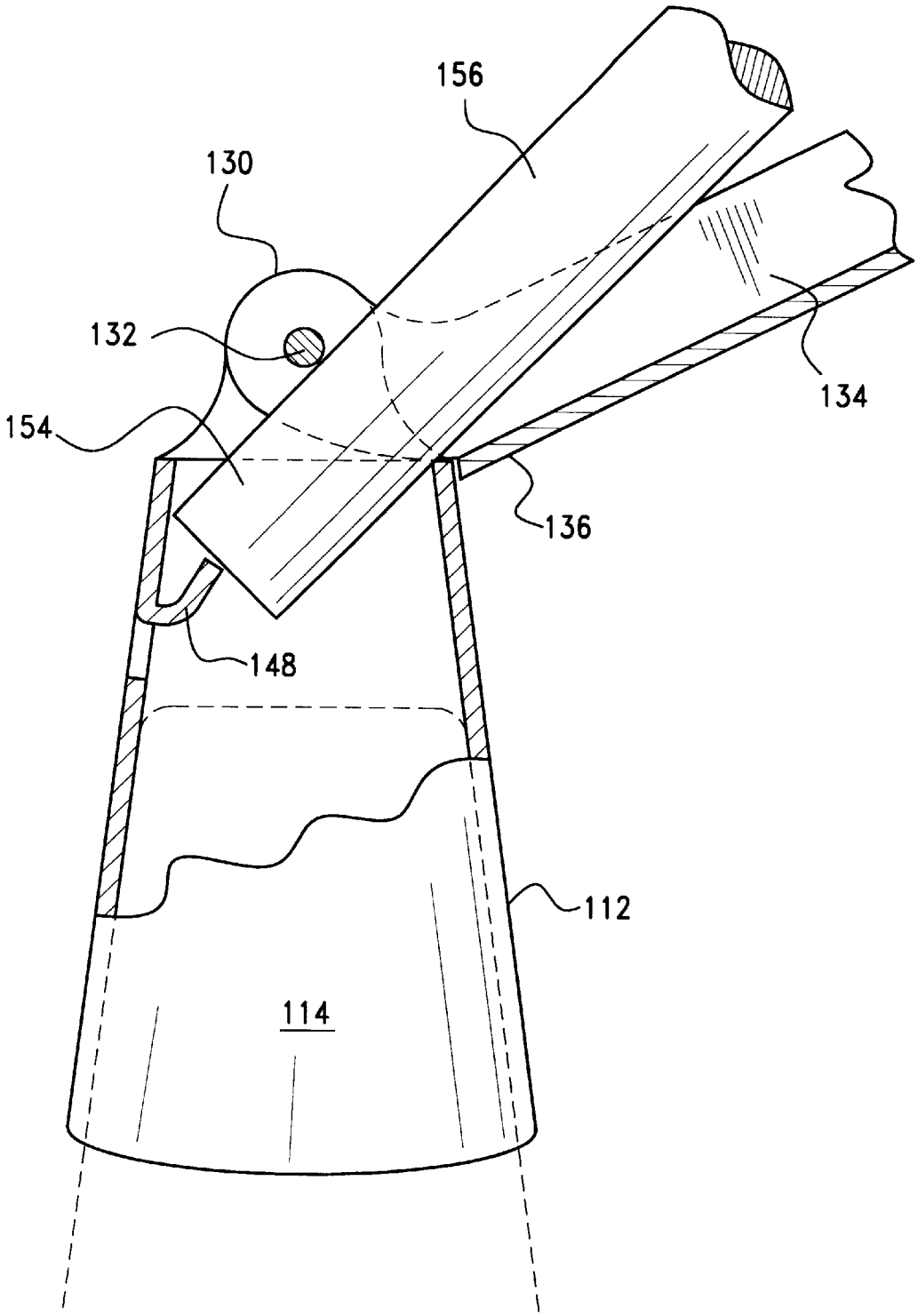
FIG. 6 is a side elevation view partly broken away and in section showing another embodiment of the invention.

In the embodiment of FIG. 6 the support member 112 is a continuous conical surface 114 so it nests over the cone top of the traffic cone. As with the embodiment of FIGS. 1–5, the upper end of the support includes a pair of spaced parallel legs 130 upstanding from the support. Extending between the legs is a hinge pin 132. A drip shield 134 is pivotally connected to the hinge pin so the shield is movable between a stowed and an operative position (the operative position being shown in FIG. 6). In the FIG. 6 embodiment, the drip shield 134 is a section of a conical surface so in the stowed position, it can rest against the conical surface 114 of the support member 112.

Extending inward from surface 114 of the support is a projection 148. The projection may be a separate member fixed to the inside of the conical surface. It is preferred however that the conical surface 114 be cut through on three sides to free a piece of the conical support. This piece is then bent inward to form the projection 148.

In use, the drip shield 134 is swung up and over the top of the support 112 to its operative position. As the operative position is reached, the swinging movement is stopped by the engagement of an end 136 of the drip shield against the surface 14 of the support member. With the drip shield swung to its operative position, the butt end 154 of a flare 156 is put under the hinge pin 132 and pressed against the projection 148. This serves to support the flare at an upward extending angle with respect to the drip shield as shown in FIG. 6.

Figure 7:
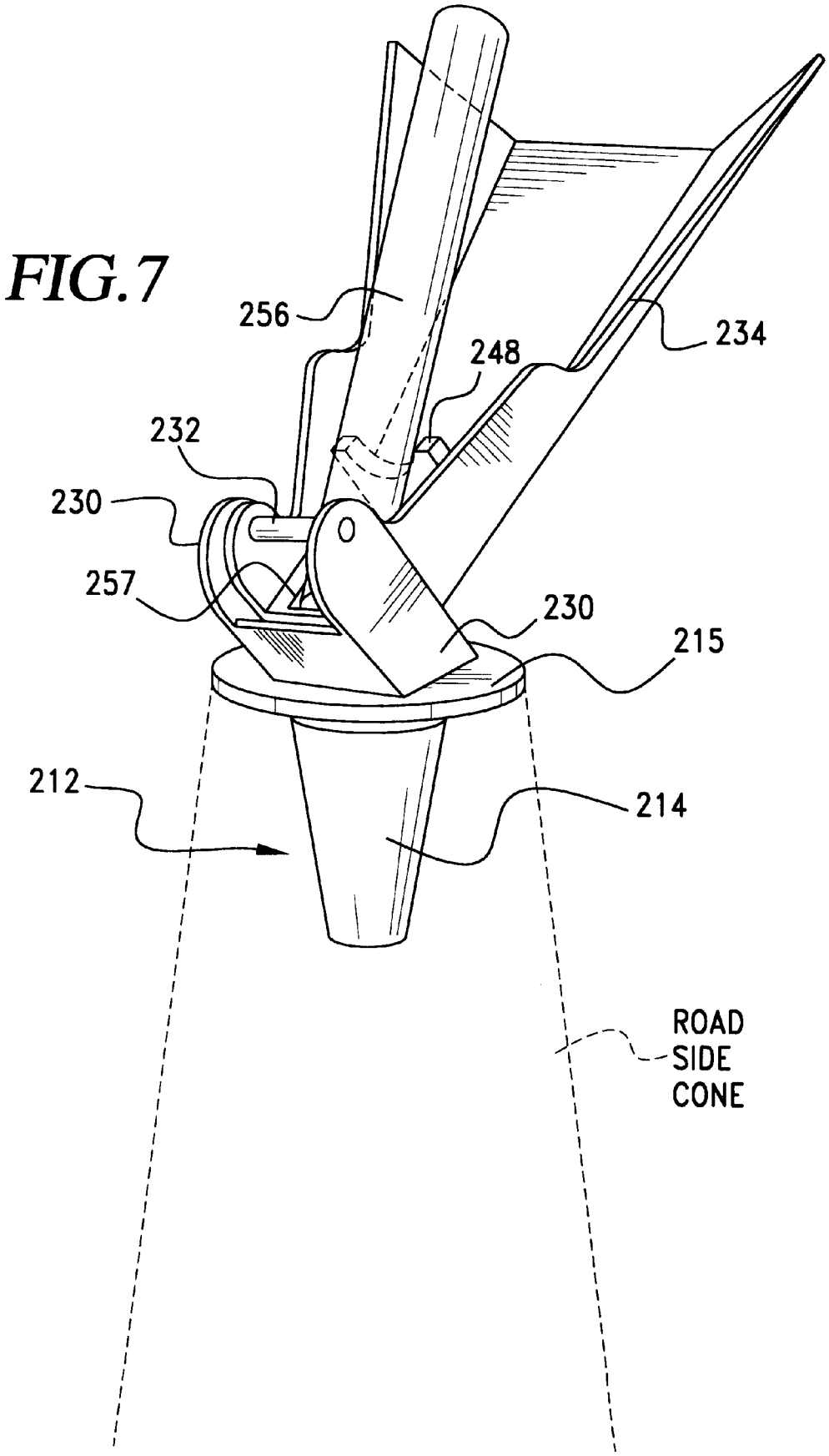
FIG. 7 is a perspective view showing still another embodiment of the present invention.

The embodiment shown in FIG. 7 has a support 212 arranged to fit into the top of the traffic cone. In this respect, the common traffic cone is hollow and has an open top. The support 212 includes a member 214 that fits into the central opening of the traffic cone. The member 214 can be weighted to keep it in position or it can be a force fit with the opening of the cone so it is retained by friction. At the top of the member is a flange 215 that settles onto the top of the cone. Upstanding from the flange is a pair of spaced parallel legs 230 and extending between the legs is a hinge pin 232. Pivotally supported by the hinge pin is a drip shield 234.

In the FIG. 7 embodiment, the projection 248 for supporting a flare 256 is similar in construction to the projection 48 of FIGS. 2–5. However, in this case the opening 257 remaining after the piece forming the projection is bent from the drip shield is adapted to receive the butt end 254 of a flare 256.

While embodiments of the flare holder of the present invention have been described in detail, it should be appreciated that various modifications are well within the skill of the art. For example, the flare holder need not be attachable to a traffic cone but can be configured for attachment to any stand, post or other upright structure. The material of the flare holder is preferably a metal but it can be formed of any suitable material such as plastic or combination of metal and plastic. High melting temperature or non flammable materials are preferred. It also is possible to shorten or eliminate a considerable length of the drip shield so as to retain only a stub portion that is pivotally connected to the hinge pin 32, 132 of the embodiments of FIGS. 15 and 7. In this case the remaining stub portion would be only long enough to accommodate the projection 48, 148. In the embodiment of FIG. 6, elimination of the drip shield provides a fare support with no ash-collecting feature.

Also, the rib structures 20, 22 of FIG. 1 may be replaced by closed rings of similar diameter. Slipping closed rigs over the conical surface of the traffic cone will lessen the possibility of the flare holder support 12 being pulled laterally off of the cone. It further should be appreciated that the support can be attached to any accommodating upright structure and is not necessarily limited to attachment to a traffic cone. Also, key hole slots 26,28 may be provided in the spine 14 (see FIG. 4) to permit the use of fasteners such as screws or the like to attach the flare holder to a post or other upright support structure.

Thus it should be appreciated that the present invention accomplishes its intended objects in providing a flare holder for holding a flare above a roadway surface. The flare holder in a preferred embodiment includes a drip shield for collecting the ashes from the burning flare wherein the drip shield is movable between an out-of-the-way stowed position and an in-use position. The flare holder is attachable to a traffic cone or other upright support for holding the flare above a roadway surface. The holder supports the flare at an upright inclination so the combustible end of the flare at a still higher elevation above the plane of the drip shield.

Having described the invention in detail, what is claimed as new is:

1. A flare holder comprising:

a) a support having a lower portion attachable to an uprigit structure and an upper portion;

b) a plate having a first end hinge connected to said support upper portion for movement of said plate about said hinge connection between a stowed position depending from said hinge and an operative position rotated more than 180° from said stowed position;

c) means on one of said plate and support adjacent said hinge connection for receiving a butt end portion of a cylindrical flare when said plate is in its operative position, said means being disposed to support the flare butt end portion such that the longitudinal axis of the flare is upwardly inclined with the combustible end of the flare disposed above the plane of said plate; and d) said plate having a portion extending beneath the combustible end of a flare for receiving ash falling from the combustible end.

2. A flare holder as in claim 1 wherein said plate has portion arranged to butt against said upper portion for holding said plate at said operative position.

3. A flare holder as in claim 1 comprising;

a) a pair of legs upstanding from said support upper portion;

b) a hinge pin extending between said legs; and c) said plate first end being pivotally attached to said pin.

4. A flare holder as in claim 3 wherein said means and said hinge pin cooperate to support a flare.

5. A flare holder as in claim 4 wherein said means is on said support and comprises a projection extending inward from said support, said support receiving an end of a flare inserted beneath said hinge pin and against said support.

6. A flare holder as in claim 4 wherein said means is on said plate and comprises a projection upstanding from said plate, said projection having an upper edge adapted to cradle a flare inserted beneath said hinge pin and laid on said upper edge.

7. A flare holder as in claim 6 wherein said projection is formed from a portion of the plate that is cut and bend upward from the plane of the plate.

8. A flare holder as in claim 1 wherein said means is on said plate and comprises;

a) a projection upstanding from said plate, said projection having an upper edge adapted to cradle a flare; and b) said plate having an opening adjacent said projection, said opening being large enough to receive a butt end of a flare inserted into said opening and laid on said upper edge whereby said opening and projection together define said means for supporting the butt end portion of a flare.

9. A flare holder as in claim 1 wherein said lower portion defines a generally conical sleeve for receiving an upper portion of a conical upright structure.

10. A flare holder as in claim 1 wherein said upright structure is a traffic cone having an open end and said support lower portion is insatiable into said open upper end for releaseably attaching said flare holder to the traffic cone.

11. A flare holder as in claim 1 wherein said plate is rotated between 180° and 270° in moving from said stowed position to said operative position.

12. A flare holder comprising:

a) a support having a lower portion attachable to an upright structure and an upper portion;

b) a plate having a first end hinge connected to said support upper portion for movement of said plate about said hinge connection between a stowed position depending from said hinge and an operative position rotated more than 180° from said stowed position;

c) means on one of said plate and support adjacent said hinge connection for receiving a butt end portion of a cylindrical flare when said plate is in its operative position, said means being disposed to support the flare butt end portion such that the longitudinal axis of the flare is upwardly inclined with the combustible end of the flare disposed above the plane of said plate; and d) said plate having a base and side walls attached to said base, said base and side walls together defining a trough and said trough in the stowed position nesting against said support lower portion and in the operative position defining an ash receptacle having an outward extending end disposed beneath the flare for receiving ash falling from the combustible end of the flare.

13. A flare holder as in claim 12 wherein said side walls are outwardly flared with said plate outward extending end being wider than said plate first end.

14. A flare holder comprising:

a) a support having a lower portion attachable to an upright structure and an upper portion;

b) a plate having a first end binge connected to said support upper portion for movement of said plate about said binge connection between a stowed position depending from said binge and an operative position rotated more than 180° from said stowed position;

c) means on one of said plate and support adjacent said hinge connection for receiving a butt end portion of a cylindrical flare when said plate is in its operative position, said means being disposed to support the flare butt end portion such that the longitudinal axis of the flare is upwardly inclined with the combustible end of the flare disposed above the plane of said plate; and d) said lower portion including i) a generally upright spine having a lower end and an upper end portion;

ii) an upper and a lower pair of rib members extending outward from said spine; and iii) said spine and ribs being arranged to removably embrace an upright support structure.

15. A flare holder as in claim 14 wherein said lower pair of ribs are longer than said upper pair of ribs such that said spine and ribs together define a generally conical shape for removably embracing a generally conical upright support structure.

* * * * *

UNITED STATES PATENT AND TRADEMARK OFFICE

CERTIFICATE OF CORRECTION

PATENT NO. : 6,527,245 B2 
DATED : March 4, 2003
INVENTOR(S) : Gary J. Graves and Steven K. Dahlberg It is certified that error appears in the above-identified patent and that said Letters Patent is hereby corrected as shown below:

Column 7,
Lines 12, 14 and 15, replace the term "binge" with -- hinge --.

Signed and Sealed this

Fifth Day of August, 2003

JAMES E. ROGAN
*Director of the United States Patent and Trademark Office*